United States Patent [19]

Hudimac

[11] 4,072,389

[45] Feb. 7, 1978

[54] STACKED, PLUG-IN RELAYS

[75] Inventor: George S. Hudimac, Allentown, Pa.

[73] Assignee: Mechanical Service Company, Inc., Allentown, Pa.

[21] Appl. No.: 797,438

[22] Filed: May 16, 1977

[51] Int. Cl.[2] ..... H01R 13/62

[52] U.S. Cl. ..... 339/119 R; 85/1 F; 211/26

[58] Field of Search ..... 85/1 F; 211/26; 339/119 R, 119 L, 120, 121; 361/391, 408, 427

[56] References Cited

U.S. PATENT DOCUMENTS

| | | | |
|---|---|---|---|
| 3,382,414 | 5/1968 | Borner | 361/391 |
| 3,420,381 | 1/1969 | Bradfield | 211/26 |
| 3,506,947 | 4/1970 | Leskosek | 339/119 R |
| 4,002,398 | 1/1977 | Hanisch | 211/26 |

*Primary Examiner*—Mark S. Bicks

*Attorney, Agent, or Firm*—Frederick J. Olsson

[57] ABSTRACT

In an electrical control panel, one relay can be stacked on the other as follows: Without removing an installed relay, the screws holding the octal base of the relay are replaced by adaptors which extend up from the base beyond the relay housing. Another octal base is mounted on the ends of the adaptors by screws threaded into the same from the second base. Another relay is then plugged into the second base. The two relays now are in stacked position. The adaptors have a yielding connection which allows the new relay and base to be moved to provide a clearance space for access to the first relay and then returned.

5 Claims, 9 Drawing Figures

STACKED, PLUG-IN RELAYS

This invention relates to electrical panels containing various electrical units such as relays and the like for use in controlling electrical equipment such as motors, process machinery, etc.

With such panels, it has been conventional to increase the lateral dimensions where a larger number of electrical units or other equipment are to be employed.

Furthermore, such a panel is dimentioned to accommodate only the units or equipment for which it was designed. Thus, it has been heretofore virtually impossible to add additional units to a panel as installed in the field. So when additional units are necessary the trade has resorted the expedient of adding a separate panel.

In lieu of increasing panel size or adding additional panels, the invention contemplates the idea of utilizing the air space over an existing unit by stacking one unit over the other. This is accomplished by adaptors which can firmly support one unit over the other but which have a yielding connection operable to permit the added unit to be quickly moved out of the way so that the lower unit can be serviced or replaced.

The principal advantages of the invention are: (a) overall lateral size of a panel can be considerably reduced as compared to a conventional panel for a given number of units; (b) the number of units in a given lateral area can be greatly increased; (c) the user can add additional units on the original installed panel; and (d) the underneath unit is readily accessible.

The invention will be explained below in connection with the following drawings wherein.

Figure 1:
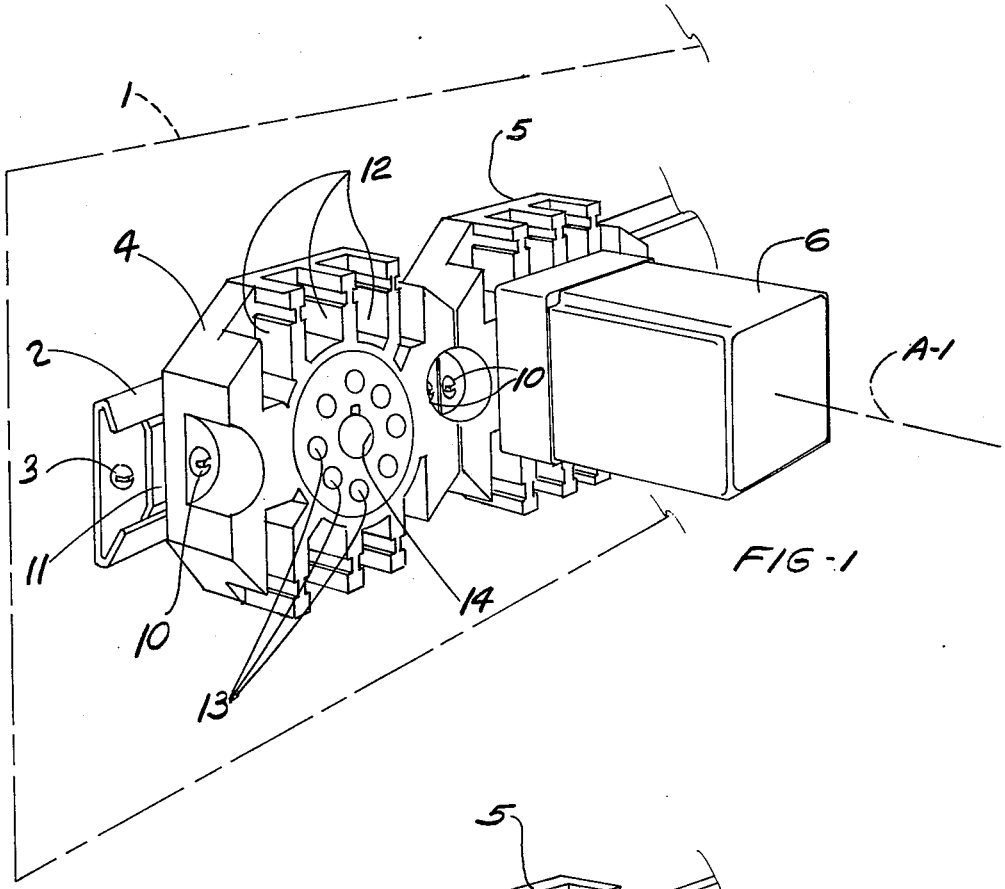
FIG. 1 is a perspective view of a pair of octal bases, the right hand one of which mounts a typical plug-in-relay.
Figure 7:
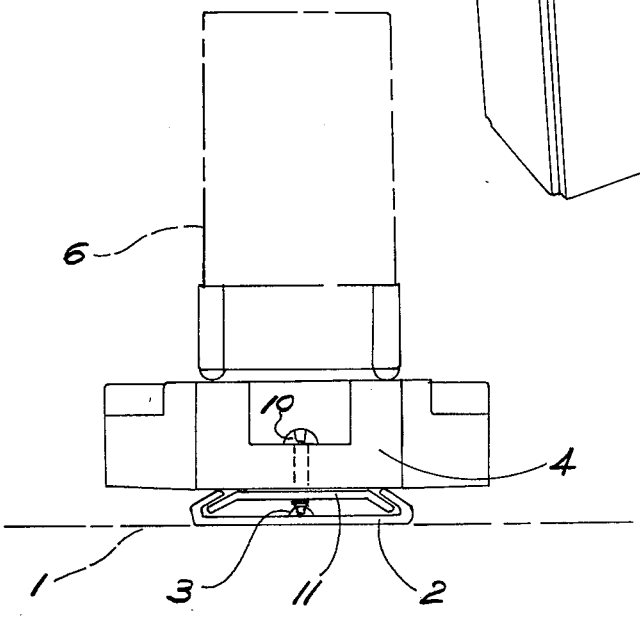
FIG. 7 is an end view looking toward the right in FIG. 1 and illustrating the octal base as mounted on a panel track.

Panels of the kind in question are either the flat-plate type with the electrical elements uncovered or the box type having a flat bottom with the electrical elements closed off by a cover. In either case, the panel is installed so that the plate or bottom extends in horizontal or vertical direction. In FIG. 1 the panel (plate or bottom) is indicated by the dotted lines 1 and extends in a vertical direction. A mounting track 2 is secured to the panel and extends across the panel in a horizontal direction. The track is secured by appropriate screws such as that indicated at 3. The track carries bases which in the present instance are each shown as a typical octal base indicated at 4 and 5. The base 5 carries the plug in electrical unit 6. The screw 10 extends thru the base (see FIG. 7) and is threaded into the wedge 11. The screw pulls the base and the wedge tight against the track. The screw/wedge arrangement permits the bases to be adjusted to a desired position along the track.

While I have shown only two bases and a single electrical unit, it will be understood that a typical track in a panel may carry several units and that a panel may carry several rows of parallel tracks.

The bases 4 and 5 are identical in construction and are typical, conventional design having the cavities 12, the bottom of which carry electrical terminals (not shown) which are joined to pin receptacles (also not shown) in the sockets 13. The base also has a polarized guide socket 14.

Figure 2:
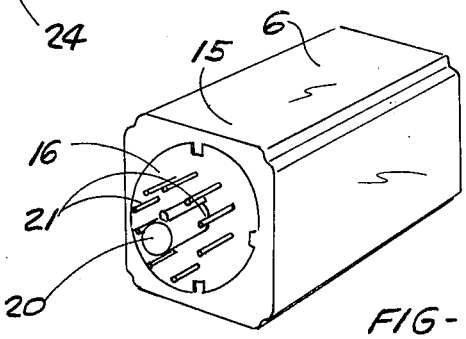
FIG. 2 is a perspective view of a typical plug-in-relay.

The unit 6 may be conventional electrical device such as a relay, capacitor, inductor, etc. In the present instance the unit 6 is in the form of a relay. As noted in FIG. 2, the relay includes the housing 15 and the base 16, a polarized guide/support pin 20 and electrical pins 21 carried by the base. The guide 20 fits into the guide socket 14 and the pins fit into the sockets 13 to mate with the pin receptacles. The relay contacts and coil are appropriately supported inside of the housing 15 and joined to the pins 21.

In a horizontal panel orientation the axes of the electrical units or relays extend in a vertical direction and in a vertical panel orientation the axes of the units or relays extend horizontally. Thus in FIG. 1 the axis A-1 of relay 6 extends horizontally in a horizontal direction. It will be understood that the terms "stacked", "over the other", "lower", etc. as used with respect to the electrical units are applicable to both vertical and horizontal orientation.

The relay 6 is adapted to be plugged into the base by a aligning the guide 20 and socket 14 and then pushing straight in. It is pulled out of the base simply by gripping the housing and pulling straight out.

It will be understood that the panel has a various wireways which carry electrical conductors connected to the terminals on the bases. This conventional type of wiring is well understood in the art and for clarity sake is not shown or described herein.

Panels of the kind in question are normally designed with lateral length and width just sufficient to accommodate the desired number of units or other apparatus.

It is a conventional rule, therefore, that where a larger number of items are to be mounted on the panel the lateral width and or length is increased. After a panel is installed, changed conditions in the array serviced by the panel often times will necessitate additional units or other equipment. When such situations arise, the conventional rule is to add another panel adjacent the one already installed.

Instead of increasing the lateral length or width during the initial design, or adding an additional panel in the field the present invention avoids this by vertical intergration or stacking one unit over the other and in doing so in a manner to provide complete access to the underneath unit. The manner in which this is accomplished will next be described.

Figure 3:
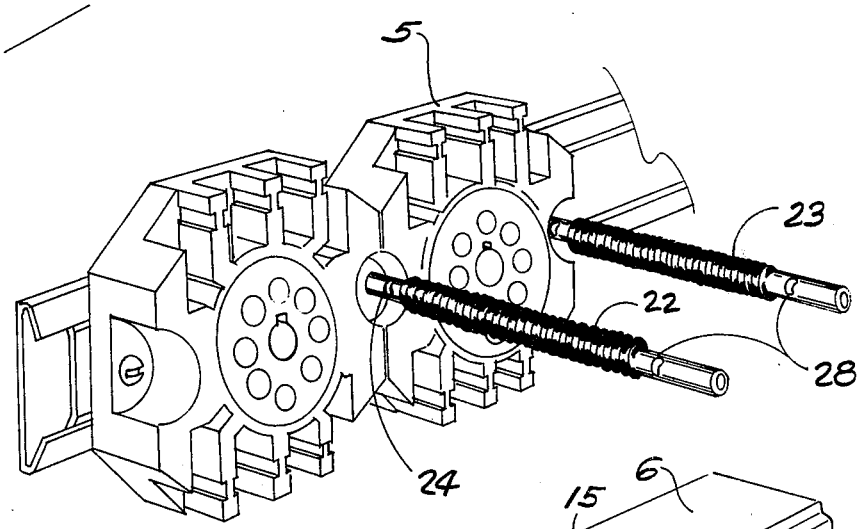
FIG. 3 is a perspective view of the assembly of FIG. 1 with the relay removed and a pair of adaptors mounted in place.

The vertical intergration or stacking while at the same time providing for access, is accomplished by means of adaptors which indicated at 22 and 23 in FIG. 3.

To install the adaptors, the relay 6 may be removed. Then one of the screws 10 holding the base 5 is removed and replaced by the adaptor 22. The adaptor is arranged to thread into the track 11 and bear on the top of the base 5. In other words the adaptor functions as if it were a screw in holding the base in place. The other screw 10 is removed and the adaptor 23 put into place. The adaptor may be tightened down by twisting a nail inserted thru the hole 24.

Figure 4:
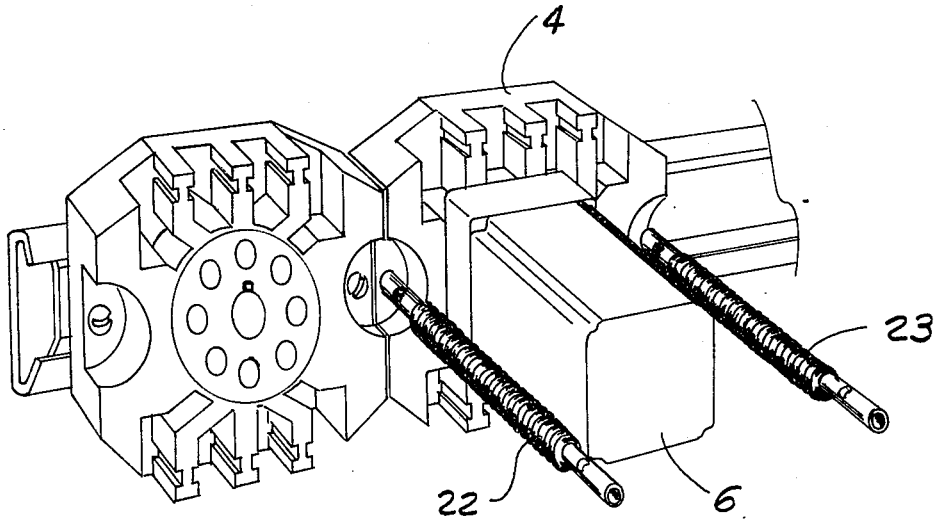
FIG. 4 is a perspective view of the assembly of FIG. 3 with the original relay replaced.

After the adaptors have been installed and firmly hold the base, the relay 6 is then plugged in as shown in FIG. 4. It will be apparent that it is not essential to remove the relay 6 for purposes of installing the adaptors. The relay 6 may be left in place particularly if it does not offer interference to removal of the screws 10 or inserting a nail in the hole 24.

Figure 5:
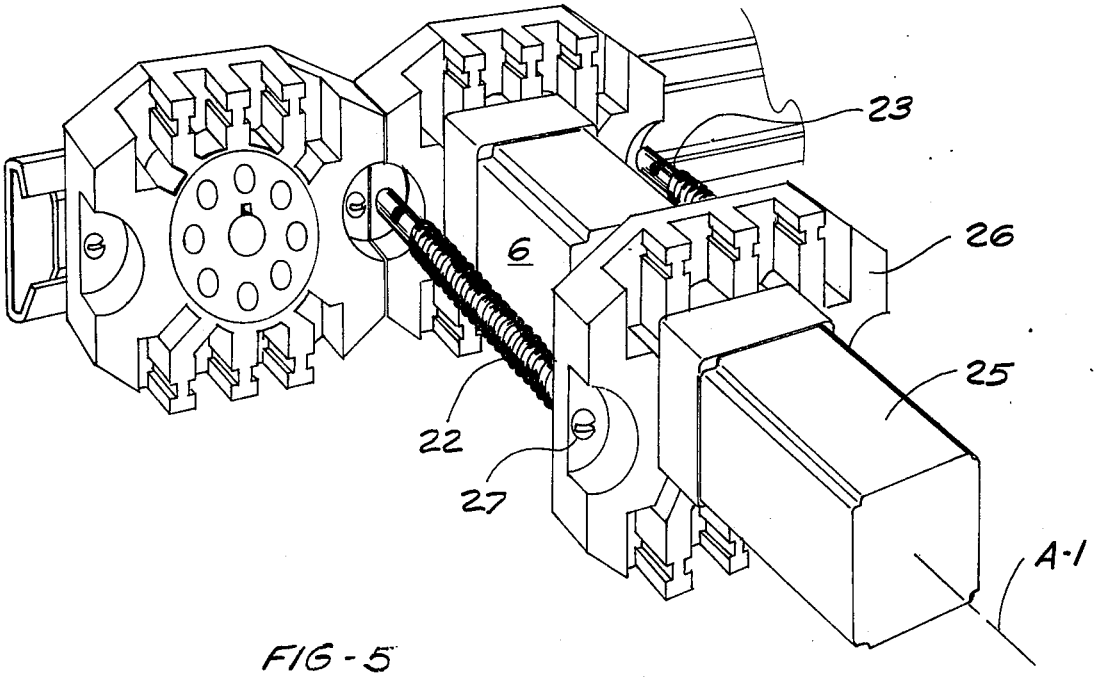
FIG. 5 is a perspective view of the assembly of FIG. 4 with another relay mounted on the adaptors.

The assembly is now ready to receive another relay and base such as the relay 25 and the base 26 as shown in FIG. 5. The base is set up the other ends of the adaptors and screws 27 (like the screws 10) are threaded into holes in the ends of the adaptors. A nail may be inserted thru the hole 28 to keep the shank 31 from twisting as the screw 27 is tightened up. The tops of the adaptors engage the bottom of the base 26. The top of the housing 15 of relay 6 is slightly spaced away from the bottom of the base 26.

Figure 6:
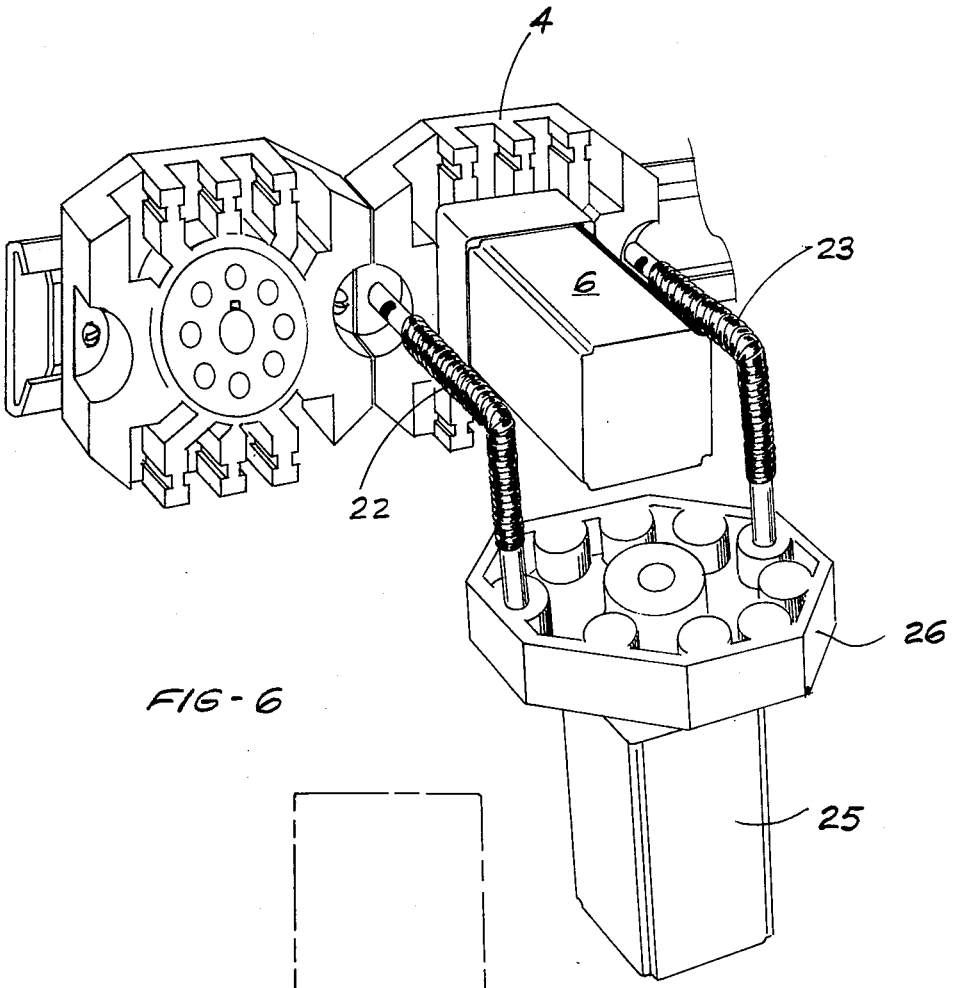
FIG. 6 is a perspective view of the assembly of FIG. 5 with the new relay and base moved into a position permitting access to the original relay.

The adaptors are constructed so that the relay 25 and base 26 can be quickly placed in position to permit free access to the relay 6. This position is shown in FIG. 6. To place the relay 25 in the base 26 in the position of FIG. 6 the base and relay as shown in FIG. 5 are grasped in the hand, pulled axially along axis A-1 and then rotated downwardly (or up) to the position of FIG. 6. The hand is then removed. The relay 25 and base 26 will remain in this position. It will be seen that the space is now provided for the relay 6 to be removed for maintenance or replacement.

To return to relay 25 and base 26 to the position of FIG. 5, the same are gripped in the hand, rotated upwardly and then allowed to move axially to the original position. It will be observed that relays 6 and 25 are serially spaced along axis A-1. A preferred adaptor structure for accomplishing the foregoing will be explained in connection with FIGS. 8 and 9.

Figure 8:
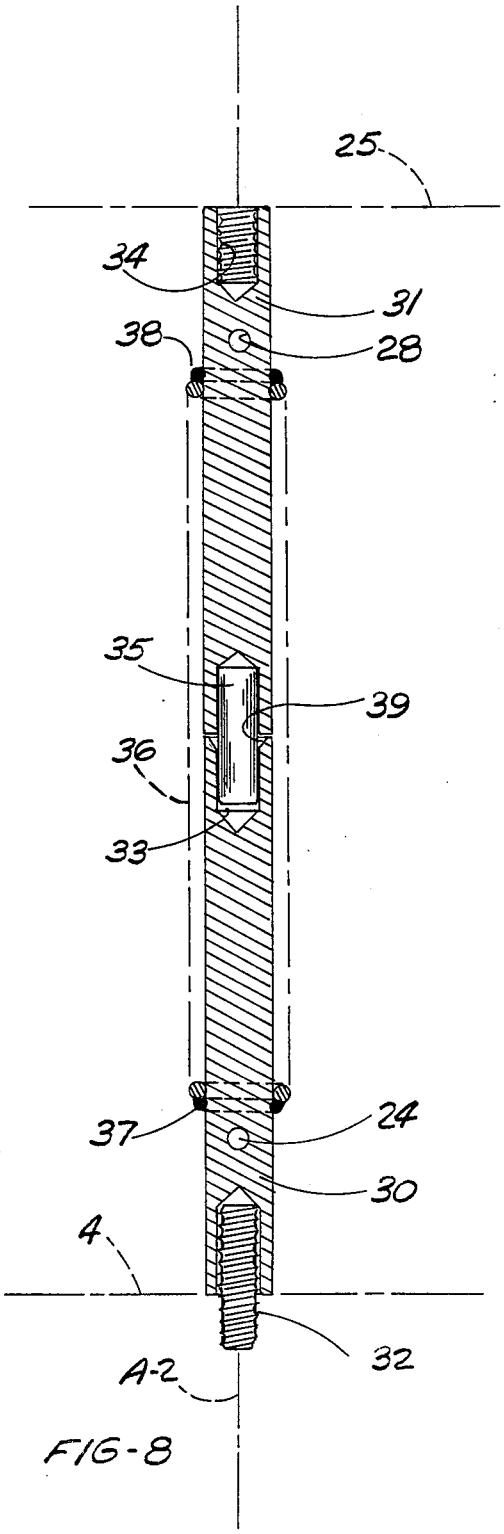
FIG. 8 is a sectional elevational view of adaptor constructed in accordance with the invention.

In FIG. 8 the generally cylindrically shaped shanks 30 and 31 are disposed along the axis A-2. The shank 30 abuts the base 4 and the shank 31 abuts the base 26. On the shank 30 there is a threaded stud 32 which extends from the end of the shank co-axial with the axis A-2. The stud 32 is secured to the shank by being tightly threaded home as shown. The stud 32 is adapted to fit into the threaded holes on the wedge 11. On the opposite end of the shank 30 is a guide socket 33 which is also co-axial with the axis A-2.

On the shank 31 there is a threaded hole 34. This threaded hole is adapted to receive the screws 27. On the opposite end of the shank 31 is a guide pin 35 which makes a snug, sliding fit with the socket 33. The pin is secured on the shank 31 as by being press fitted onto an appropriately sized aperture.

Around the shanks 30 and 31 is a spring 36. One end of the spring is soldered to the shank 30 as indicated at 37. The other end is soldered to the shank 31 as indicated at 38.

Normally, the spring urges the shanks together so that the pin 35 is yieldably retained in the socket 33 as shown in FIG. 8. The socket 33 is chamfered as at 39. The guide pin 35, the socket 33 and spring 36 co-operate so that when the guide pin is positioned as shown in FIG. 8 the adaptor is an elongated member which is substantially rigid. As noted in FIG. 5, the elongated members or adaptors 22 and 23 are capable of forming cantilever supports for the relay 25.

Figure 9:
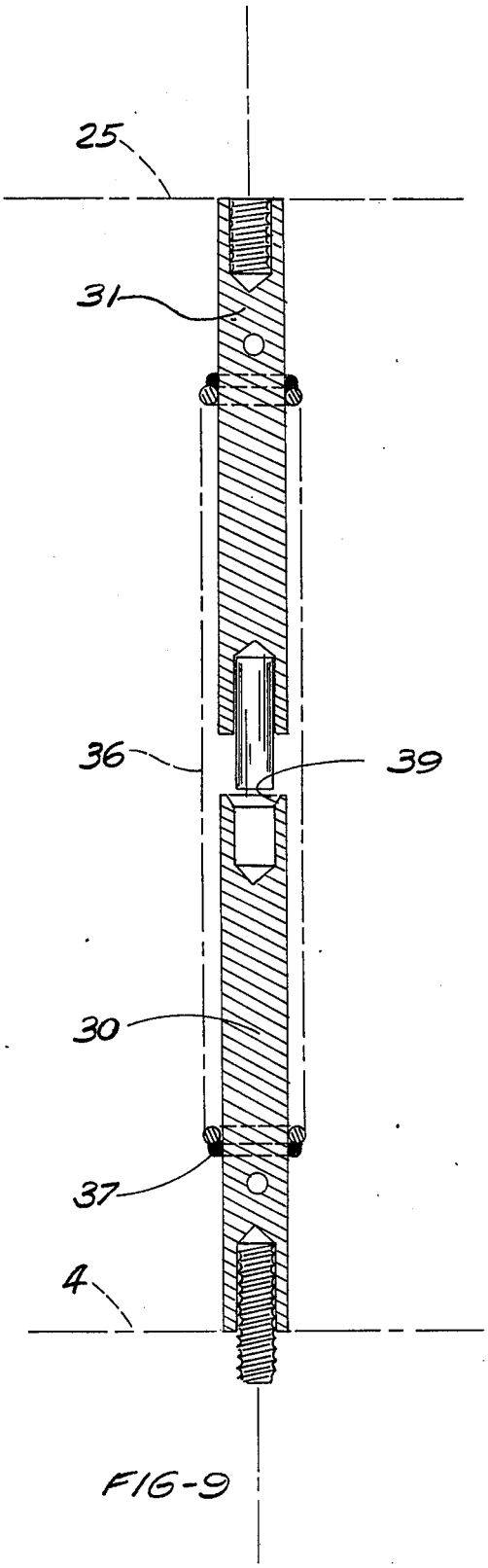
FIG. 9 is a sectional view of the adaptor of FIG. 8 in an extended condition.

The spring 36 permits the shank 31 to be moved axially so the pin 35 can be removed from the socket 33 as shown in FIG. 9. This allows the relay 25 and base 26 to be pulled backwards as previously mentioned.

The spring 36 also allows the shank 31, relay 35 and base 26 to be turned or oriented as shown in FIG. 6 and to temporarily remain in that position.

When the relay 25 and base 26 are to be returned from the position of FIG. 6 to the position of FIG. 5, the same are grasped in the hand and rotated upwardly to the horizontal position. The spring permits this rotation and draws the base and relay inwardly so that the guide pins 35 urges the sockets 33 to re-establish the adaptors as substantially rigid members.

I claim:

1. An adaptor for use in supporting first and second electricals units, each unit having a mounting base and a housing adapted to be removeably plugged into the base and when the units are supported the top of the housing of the first unit being closely adjacent the bottom of the base of the second unit, the adaptor comprising:

an elongated member including a pair of shanks;

means on one end of one shank for connecting the member to the top of the base of the first unit;

means on one end of the other shank for connecting the member to the bottom of the base of the second unit;

means on the shanks to be engaged whereby to form a substantially rigid part to support the second unit with respect to the first unit and to be disengaged to permit the second unit to be moved with respect to the first unit;

a spring surrounding the shanks, the opposite ends of which are respectively connected to the shanks and the spring urging the shanks into said engagement; and said spring and said means on the shanks providing for the second unit to first be moved in a direction along the axis of the member to separate the shanks and effect said disengagement and secondly be moved laterally with respect to the axis without the member being disconnected from either base and the second lateral movement placing the second unit in a position to allow the first unit to be removed and/or replaced.

2. An adaptor for use in supporting first and second electrical units, each unit having a mounting base and a housing adapted to be removeably plugged into the base and when the units are supported the top of the housing of the first unit being closely adjacent the bottom of the base of the second unit, the adaptor comprising:

an elongated member including a pair of shanks;

means on one end of one shank for connecting the member to the top of the base of the first unit;

means on one end of the other shank for connecting the member to the bottom of the base of the second unit;

means on the shanks to be engaged whereby to form a substantially rigid part to extend in a horizontal direction to support the second unit with respect to the first unit and to be disengaged to permit the second unit to be moved with respect to the first unit;

a spring surrounding the shanks, the opposite ends of which are respectively connected to the shanks and the spring urging the shanks into said engagement; and said spring and said means on the shanks providing for the second unit to first be moved in a horizontal direction along the axis of the member to separate the shanks and to effect said disengagement and secondly be moved laterally with respect to the axis without the member being disconnected from either base and the second lateral movement placing the second unit in a position to allow the first unit to be removed and/or replaced.

3. In an electrical service box:

first and second mounting bases spaced apart from one another along an axis;

first and second electrical units co-axial with said axis and respectively removeably plugged into the first and second bases;

a pair of adaptors respectively disposed on opposite sides of said units;

each adapter including a pair of shanks and a spring surrounding each pair of shanks, the opposite ends of each spring are respectively connected to the shanks of one of the adapters and corresponding shanks in each adaptor being respectively removeably connected to the top of the first base and to the bottom of the second base;

for each adaptor, means on its shanks to be engaged whereby to form a substantially rigid parts to support the second unit with respect to the first unit and to be disengaged to permit the second unit to be moved with respect to the first unit; and in each adaptor said spring and said means on the shank providing for the second unit to first be moved in a direction along said axis to separate the shanks and effect said disengagement and secondly be moved laterally with respect to said axis without the adaptor being disconnected from either base and the second lateral movement placing the second unit in a position to allow the first unit to be removed and/or replaced.

4. An adaptor for use in supporting first and second electrical units, the adaptor comprising:

first and second shanks co-axially disposed along an axis;

a threaded stud on the first shank extending from one end of the first shank co-axial with said axis;

a guide socket adjacent the opposite end of the first shank and extending inwardly and co-axial with said axis;

a guide pin fixed to and extending from one end of the second shank co-axial with said axis and adapted to slidingly engage said socket and be retained therein or removed therefrom;

a threaded hole adjacent the opposite end of the second shank and co-axial with said axis; and a spring surronding the shanks, one end of the spring being fixed to the first shank and the opposite end of the spring being fixed to the second shank, the spring urging the shanks toward each other whereby the guide pin is yieldably retained in said socket.

5. An adaptor for use in supporting first and second electrical units, each unit having a mounting base and a housing adapted to be removeably plugged into the base and when the units are supported, the top of the housing of the first unit being closely adjacent the bottom of the base of the second unit, the adaptor comprising:

first and second shanks co-axially disposed along an adaptor axis, the first shank to be secured on the top of the base of the first unit and the second shank to be secured on the bottom of the base of the second unit;

a threaded stud on the first shank extending from one end of the first shank co-axial with said adaptor axis for extending thru the base of the first unit;

a guide socket adjacent the opposite end of the first shank and extending inwardly and co-axial with said adaptor axis;

a threaded hole adjacent the one end of the second shank and co-axial with said adaptor axis to receive a mounting screw in the base of the second unit;

a guide pin fixed to and extending from the opposite end of the second shank co-axial with said adaptor axis and adapted to slidingly engaged said socket and be retained therein or removed therefrom;

a spring surrounding the shanks, one end of the spring being fixed to the first shank and the opposite end of the spring being fixed to the second shank, the spring urging shanks toward each other whereby the guide pin is yieldably retained in said socket;

said guide, socket and spring providing:

a. that when the guide pin is in the socket, the two shanks and pin form a substantially rigid member capable of extending in a horizontal direction and forming a cantilever support for the second unit;

b. for the second shank to be moved along the adaptor axis away from the first shank to remove the guide pin from the socket and then be oriented at an angle to the shank axis to laterally move the second unit to place the same in a position to allow the first relay to be removed and/or replaced.

* * * * *

UNITED STATES PATENT OFFICE

CERTIFICATE OF CORRECTION

Patent No. 4,072,389 Dated Feb. 7,1978

Inventor(s) George S. Hudimac, Jr.

It is certified that error appears in the above-identified patent and that said Letters Patent are hereby corrected as shown below:

That the abbreviation --Jr.-- be inserted after the name "Hudimac."

Signed and Sealed this

*Twenty-seventh* Day of *June 1978*

[SEAL]

*Attest:*

RUTH C. MASON
*Attesting Officer*

DONALD W. BANNER
*Commissioner of Patents and Trademarks*